US007421828B2

(12) United States Patent
Reynolds

(10) Patent No.: US 7,421,828 B2
(45) Date of Patent: Sep. 9, 2008

(54) INTEGRAL FORMING TECHNOLOGY, A METHOD OF CONSTRUCTING STEEL REINFORCED CONCRETE STRUCTURES

(76) Inventor: Milton Reynolds, 10912 Montrose Ave., Tampa, FL (US) 33617

( * ) Notice: Subject to any disclaimer, the term of this patent is extended or adjusted under 35 U.S.C. 154(b) by 688 days.

(21) Appl. No.: 10/968,595

(22) Filed: Oct. 19, 2004

(65) Prior Publication Data

US 2005/0086900 A1 Apr. 28, 2005

Related U.S. Application Data

(60) Provisional application No. 60/513,675, filed on Oct. 23, 2003.

(51) Int. Cl.
*E04B 1/00* (2006.01)
*E04G 21/00* (2006.01)
*E04G 23/00* (2006.01)

(52) U.S. Cl. ..... 52/745.2; 52/742.14; 52/745.19; 52/79.11; 52/319; 52/742.1

(58) Field of Classification Search ... 52/742.1–742.14, 52/745.19, 309.16, 309.17, 309.7, 309.8, 52/309.9, 309.11, 425, 426, 444, 454, 354, 52/344, 745.2, 79.5, 79.9, 79.11, 79.12, 79.14, 52/319, 322, 323, 745.02, 745.08, 745.1, 52/745.13, 745.16
See application file for complete search history.

(56) References Cited

U.S. PATENT DOCUMENTS 4,050,213 A * 9/1977 Dillon ..... 52/742.14
4,065,905 A * 1/1978 van der Lely ..... 52/745.02
4,409,764 A * 10/1983 Wilnau ..... 52/127.3
4,450,617 A * 5/1984 Dillon ..... 29/430
4,731,971 A * 3/1988 Terkl ..... 52/742.14
4,918,897 A * 4/1990 Luedtke ..... 52/742.14
4,924,641 A * 5/1990 Gibbar, Jr. ..... 52/204.1
5,038,541 A * 8/1991 Gibbar, Jr. ..... 52/295
5,048,257 A * 9/1991 Luedtke ..... 52/747.1
5,890,341 A * 4/1999 Bridges et al. ..... 52/745.2
6,000,192 A * 12/1999 Cohen et al. ..... 52/745.2
6,041,561 A * 3/2000 LeBlang ..... 52/234
6,058,668 A * 5/2000 Herren ..... 52/241
6,067,771 A * 5/2000 Blankenship ..... 52/745.2
6,155,279 A * 12/2000 Humphrey ..... 135/87
6,519,904 B1 * 2/2003 Phillips ..... 52/309.12
6,622,452 B2 * 9/2003 Alvaro ..... 52/742.14
6,629,388 B2 * 10/2003 Cohen ..... 52/79.9
6,681,544 B2 * 1/2004 Wall ..... 52/745.2
6,705,051 B1 * 3/2004 Wall ..... 52/66
7,185,467 B2 * 3/2007 Marty ..... 52/425
2002/0092251 A1 * 7/2002 Alvaro et al. ..... 52/309.1

(Continued)

*Primary Examiner*—Richard E. Chilcot, Jr.
*Assistant Examiner*—Andrew J Triggs
(74) *Attorney, Agent, or Firm*—Dennis L. Cook

(57) ABSTRACT

A method for constructing factory prefabricated and finished load bearing wall panels and monolithic ceiling/floor sections and modules comprised of the same for use in a single family or single story building as well as a multi-level and multi-unit building. The integrally formed wall panels are constructed of modified steel studs, rigid insulating material, and metal lathe and are factory finished with plaster or stucco like material. A void is defined by the modified steel studs window casings and door jambs. Upon erection and assembly at the job site, steel rebar is placed in such voids that are then filled with concrete, thereby eliminating the need for any additional concrete form work.

13 Claims, 18 Drawing Sheets

U.S. PATENT DOCUMENTS

2002/0178676 A1* 12/2002 Yost et al. ..... 52/426
2003/0041555 A1* 3/2003 Scallan et al. ..... 52/742.14
2003/0150182 A1* 8/2003 Chou et al. ..... 52/309.8
2003/0167718 A1* 9/2003 Alderman ..... 52/407.3
2005/0086900 A1* 4/2005 Reynolds ..... 52/745.19

* cited by examiner

Figure 2a
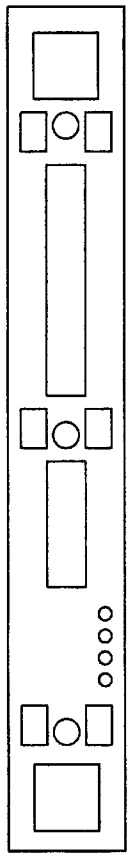
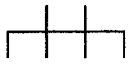
Figure 2b
Figure 2c
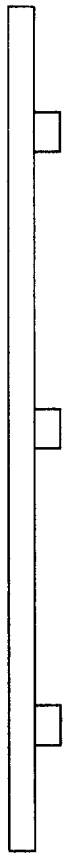
Figure 2d
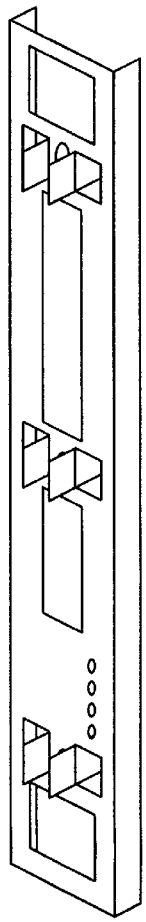

INTEGRAL FORMING TECHNOLOGY, A METHOD OF CONSTRUCTING STEEL REINFORCED CONCRETE STRUCTURES

CROSS-REFERENCE TO RELATED APPLICATION

The present application claims the benefit of previously filed co-pending Provisional Patent Application, Ser. No. 60/513,675.

FIELD OF THE INVENTION

The field of the invention relates generally to a method of construction and more specifically to constructing factory prefabricated and finished forms for load bearing wall panels, ceiling/floor sections, roof sections and modules comprised of the same for use in a single family or single story building as well as for use in a multi-level and multi-unit building.

BACKGROUND OF THE INVENTION

Noncombustible, building construction typically is of one of five basic structural types or combinations thereof: 1) reinforced concrete frame; 2) reinforced wall bearing masonry; 3) structural steel framework; 4) precast concrete framework; or 5) light gage steel bearing wall. Each of these methods of construction is subject to cost disadvantages due to one or more of: time, labor, materials, weight, and complexity of assembly. Reinforced concrete frame construction requires the on site labor and time to build forms for the wet concrete, waiting for it to harden, and then time and labor to remove the used forms. Thereupon, the building is completed and finished on site with expensive job site labor and materials. Reinforced wall bearing masonry uses concrete block walls held together with mortar, then reinforced with steel rods and filled with concrete to produce the bearing walls. This approach is used extensively in residential construction but is limited to a few stories high. The biggest disadvantage has to do with adding plumbing, wiring and finishing material with job site labor, at prime cost. Structural steel or pre-cast concrete framework construction is commonly used in high-rise work, but require the heavy steel or concrete supporting frame structure; the ceilings, walls and all the interiors and exteriors to be completed and finished with on site labor and materials, a costly construction.

Light gage steel bearing wall construction employs framing partitions of light gage steel members assembled into panels. These members are load bearing and can be assembled into panels at the job site, prior to erection, but can be assembled more economically in a controlled factory environment. However, the remainder of the building then is completed and finished with costly job site labor and materials.

U.S. Pat. No. 4,409,764 by Wilnau discloses a system for constructing the structural framework of a building or other structure of reinforced concrete that is characterized by column and beam forms of sheet metal which remain in place as permanent parts of the framework after being filled with concrete. These forms are factory-assembled, together with the necessary internal metal reinforcing skeletons, and shipped to the building site ready for erection of the column forms and interconnection thereof by the beam forms. When the column and beam structure is complete, the curtain walls must be assembled and finished on site. This current invention describes a system of load bearing walls which function as curtain walls as well as the super structure.

U.S. Pat. No. 5,048,257 by Luedtke discloses a method of constructing multiple story buildings, particularly detention structures, whereby the framing members are lightweight steel channel members that are generally similar and in certain applications, interchangeable. The walls and floors of the building are framed with the channel members and lathe sheathing is applied, with cementitious fill there between. This specification does explain a stay in place forming system. It describes the placement of the fill as being observed through the lath to assure a solid fill. Luedtke later explains the subsequent application of cement plaster or stucco like material. This terminology necessarily infers that the plaster or stucco like material is applied after the concrete has cured, possibly to assure a straight wall that bowed during the placement of plastic concrete. The Luedtke design discusses a method of concrete delivery consisting of a fill hose as pictured in FIG. 6 of the patent. This practice is not practical and probably not possible, at least not at the low slump mentioned and required to achieve the strength provided by the proper water to cement ratio.

While both Wilnau and Luedtke combine the advantages of reinforced concrete and steel framework by using portions of the steel framework as non-removable forms for the poured concrete columns and beams, these inventions do not take full advantage of the efficiencies and cost savings that can be obtained by factory prefabrication of not only the structural wall panel, but also of the window casings and door jambs contained in the wall panels that also serve as an integral form for receiving the poured concrete. Further, these inventions do not take advantage of the cost-savings that can be achieved by factory pre-finishing the wall panels with plaster or stucco like material and paint or wallpaper.

Another invention, U.S. Pat. No. 3,983,368 by Perrin discloses an invention whereby a wall is formed as by spraying cementitious material through and around two panels of sheet material thus to produce a composite wall with a hollow core therebetween, such core to be filled with a rigid material. This design is a sandwich panel where the core is described as a cellulostic material referred to as corrugated paperboard or cardboard. The voids within the core appear to be very small at least as compared to the current invention which is a forming system for achieving conventional steel reinforced concrete in a more economical fashion. Although Perrin's wall panel contemplates a sprayed plaster or stucco like material finish, just as in Wilnau and Luedtke, it also does not take advantage of prefabricating window and door jambs as an integral part of the framing structure. Further, Perrin's invention relies on the use of a reinforced rigid core for its load-bearing properties. While suitable for residential housing, such construction will not provide the load-bearing capacity that the use of conventional steel reinforced concrete provides as disclosed in the present invention.

The Anderson U.S. Pat. No. 5,996,293 describes a window buck devoted to providing an opening. The current invention does define an opening but the hollow metal jamb also functions as an integral part of the structural framework, provides a stop for the mounting of doors and windows and is ideally suited as a termination device for the finished surfaced surfaces.

SUMMARY OF THE INVENTION

The present invention discloses a method that overcomes the disadvantages of prior art by taking full advantage of the efficiencies and cost savings that can be obtained by factory prefabrication of a much larger unit of construction with far more value added under industrialized conditions where both cost and quality can be controlled. All effort is to be expended at the time and place where the benefit can be maximized while the cost is minimized. Everything that is ever to go inside a wall, ceiling or roof section is to be added as the section is being assembled on the framing table, except the steel reinforcement (rebar) and concrete. Every surface of every section that should ever be finished will be finished on the framing table in the horizontal position with the side to be finished facing up. Notable exceptions are the surfaces that must be left open to place the steel and concrete. In the case of wall sections, the top surface will never be exposed. The top surface of the floor section will be exposed but it is much less costly to field apply the concrete from the top and finish the floor than apply the concrete from the bottom and finish the ceiling. The roof section is a different matter; it is much less expensive to apply the concrete from the bottom and finish the ceiling than to finish the roof surface. Finished surfaces include paint, wall paper, veneer of every type and roof covering.

The integrally formed wall panels are constructed of modified steel studs, rigid insulating material, and metal rib-lathe imbedded in plaster or stucco like material or stucco type material. The three elements of the side wall function as a composite material of structural integrity sufficient to withstand the forces of the plastic concrete added at the job site. The primary function of the steel stud is to hold the two composite sides in place during hauling, erection and the placement of concrete. A second objective is to hold the rigid insulation in place until the plaster or stucco like material or stucco type material has been applied. The primary function of the insulation is to act as a thermal resistance, but it also acts as a back stop for the plaster or stucco like material or stucco type application and as an integral part of the composite side wall. The rib-lathe is steel reinforcement for the plaster or stucco like material or stucco type but the rib is also the member that holds the studs in place during the fabrication of the wall section. Notice that top and bottom plates, as is normally used in conventional construction to hold the studs in place, must be avoided in this design in order to keep the void open for easy access at the top, and for interconnection at the bottom.

The integrally formed monolithic ceiling/floor panels are constructed of U-shaped "gull wing" steel joists, rigid insulation, "C" channels, metal lathes, and plaster or stucco like material. As in the wall section, the insulation, lathe and plaster or stucco like material are combined to create a composite material, sufficient to withstand the forces of hauling, erection and the application of the finished floor. The joists are placed in position first and must be of sufficient size and strength to span the required distance and support the application of reinforcement steel, and the concrete, which is, field applied later. The insulation is installed second and then the "C" channels are placed at the ends of the joists. These are necessary to hold the system together for assembly, hauling and erection. This section is fabricated on the framing table in the upside down position, which is with the ceiling facing up. Next the lathe is added and the plaster or stucco like material is applied and finished.

In general sections are made up of parts. Sections are assembled to create modules. A module is made up of four wall sections and one ceiling/floor section. The ceiling of one module will function as the floor of the module above. Each is a five-sided cube. The module, which is hauled and erected at the job site, does not have either a bottom or a floor. This configuration of a 5 sided cube allows the wheels of the carrier to come up inside the module thus lowering the center of gravity and allowing a higher ceiling while still allowing clearance under highway overpasses. The ceiling/floor section, serving as the top, provides a work platform for tradesmen in lieu of scaffolding.

Finally, the roof section is made up of a sheet metal covering, joists that function as rafters, and rigid insulation. The sheet metal is stamped or roll formed and pre-finished to achieve the correct appearance and functions as an integral part of the structural system. The joists are placed into position with the opening facing down and the insulation is then added. A ridge beam and cornice are added. The roof covering is then installed. The mechanical fasteners holding the roof covering membrane should always be at the high point of the membrane rather than in the trough where water would flow. The final roof assembly is field installed so that the rebar can be added and interconnected with adjacent sections before the zero slump concrete is shot into place. The rib-lathe and plaster or stucco like material are then applied and finished.

The primary objective of this specification is to describe Integral Forming Technology in terms of sections and modules where wall, ceiling and roof surfaces are machine finished and internally complete except for the steel reinforcement and concrete. These forms receive the concrete without distortion and remain as useful, functional and integral parts of the final product. It is important to note that every wall, including the smallest closet wall, is constructed the same way; every wall is structural and load bearing and functions as an integral part of the entire structure. Storm like forces are transmitted from any element to every adjoining element to the extent that every force is distributed equally throughout the monolithic whole.

It is therefore an object of the present invention to provide a method for constructing a unit of construction that, compared to traditional concrete and steel construction methods, has far more "value added" under industrialized conditions where cost and quality can be controlled.

It is therefore a further object of the invention to provide for a method of construction for factory prefabrication of load bearing wall panels and monolithic ceiling/floor sections for use in multi-story buildings.

It is a further object of the invention to provide a method of construction for constructing a wall panel consisting of studs and window casings and door jambs that creates an integral form for the concrete core thereby eliminating the need for any additional concrete form work on the job site.

It is a further object of the invention that the lighter-weight elements of standard construction methods that are labor and skill intensive are to be assembled and pre-finished in the factory taking advantage of automated machinery. After the integral forms have been transported to the site and erected, the heavy elements, re-bars and concrete, are placed in the forms.

It is a further object of the present invention to realize cost savings, efficiencies, and improved quality control by factory finishing both sides of the wall panels, the ceiling of the ceiling/floor section, and the top roof surface.

It is also an object of the present invention to create a construction system where the pre-finished forms are made up of individual materials combined to function as composites, which act in unity and therefore create a homogenous whole. The formed sections and modules provide ample access to field install steel reinforcement and place concrete to achieve a monolithic superstructure where every section mutually supports every adjoining section.

It is an object of the present invention to create a monolithic, ceiling/floor section structural unit that is more cost-efficient and has better structural integrity than individually constructed floor and ceiling elements.

It is an object of the present invention to create pre-finished sections useful for building anything that should be steel reinforced concrete, including but not limited to fences and walls of every type.

The accompanying drawings, which are incorporated in and constitute a part of this specification, together with the description, serve to explain the principles of the invention. The description of the preferred embodiment of this invention is given for purposes of explaining the principles thereof, and is not to be considered as limiting or restricting the invention since many modifications may be made by the exercise of skill in the art without departing from the scope of the invention.

BRIEF DESCRIPTION OF DRAWINGS

The following figures set forth the preferred embodiment of the present invention:

FIGS. 2*a*, 2*b*, 2*c*, and 2*d* depicts views of a metal stud, modified to facilitate the manufacture of integral forms as described by this specification;

DETAILED DESCRIPTION OF THE INVENTION

Figure 1:
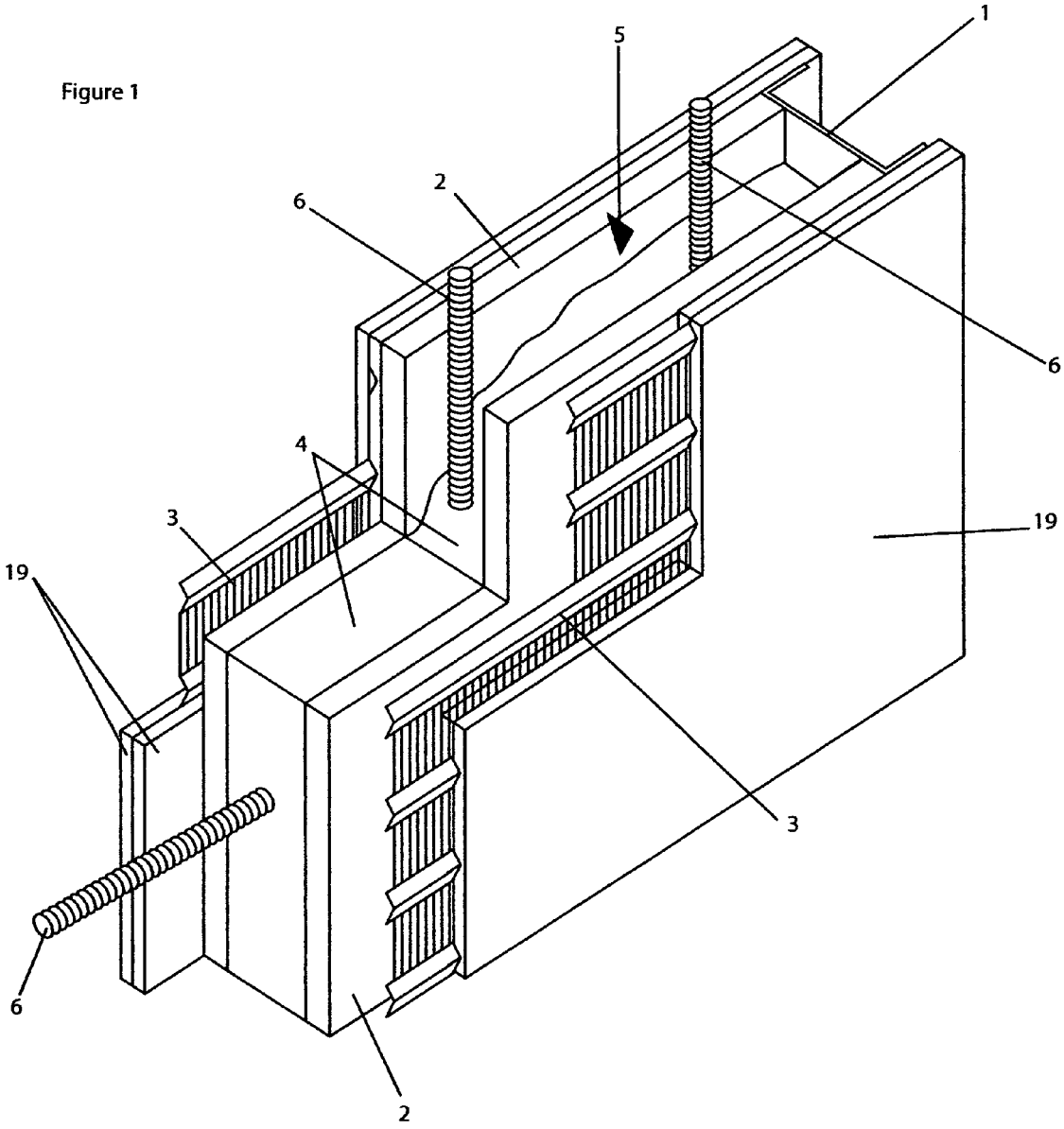
FIG. 1 depicts an overview of the concept.

Integral Forming Technology (IFT) describes a method of factory finishing wall, ceiling and roof sections where all of the internal elements are included. The sections can be assembled into modules in the plant or erected on the site. The sections and or modules appear to be finished except the steel reinforcement (rebar) and concrete has not been placed. Integral forms are best described as a much larger unit of construction, with far more value added under industrialized conditions, where both cost and quality can be controlled. The integral forms can be stacked and arranged with the flexibility to achieve virtually any architectural effect. Integral forming is a method of constructing steel reinforced concrete buildings of any size and for any purpose. The disclosed system has been designed to enclose more space that is more desirable, more attractive and more comfortable, is more structurally significant; and, is less expensive to build, operate and maintain than any currently available. To better explain the preferred embodiment of the invention the following numbering system is used:

1. Modified Stud
2. Rigid Insulation
3. Rib lathe
4. Concrete
5. The Void
6. Steel reinforcement
7. Gull wing joist
7.*a* Single wing joist
8. Opening jamb frame
9. Plaster or Stucco like material stop
10. "C" channel
11. Wall section assembly
12. Ceiling/floor section assembly
13. Module
14. Pre-finished sheet steel roof membrane
15. Steel reinforcement holes
16. Wiring/plumbing holes
17. Attachment clips
18. Mechanical fastener
19. Plaster or Stucco like material
20. Tabs
21. Cornice Referring now to the drawings FIG. 1 discloses an overview of the concept showing how the pre finished sides of the integral form will be held in place relative to each other by the modified studs (1) creating the voids (5) which are readily accessible to receive the field placement of the steel reinforcement (6) and concrete (4).

Figure 8:
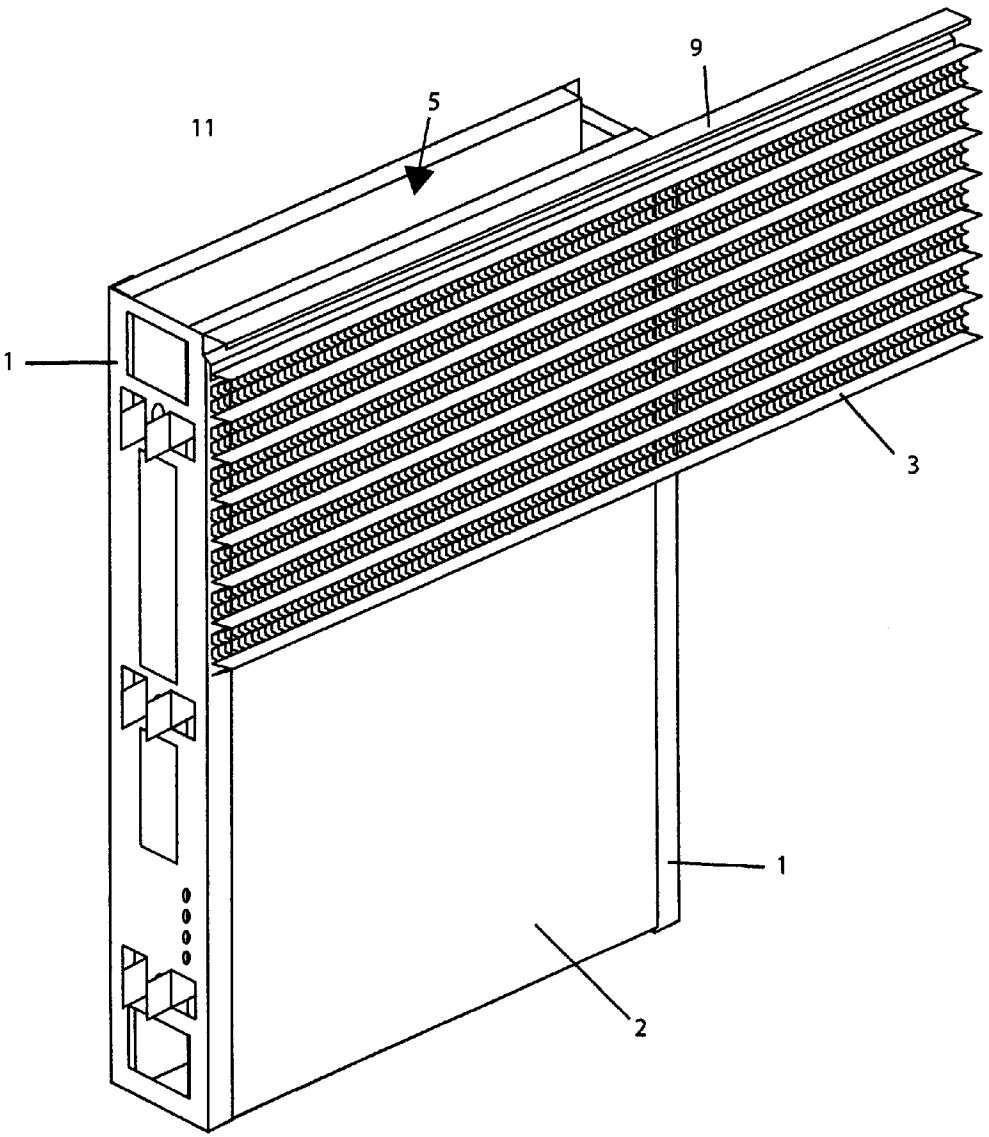
FIG. 8 depicts an assembly of wall section.

FIGS. 2*a*, 2*b*, and 2*c* discloses views of modified studs (1); Unmodified studs are currently produced in large quantity and in a number of sizes and gauges of sheet metal that are well known in the art. The standard studs are easily modified with tabs and voids as shown in the figures. The modified studs (1) are in a wall section assembly (11), as shown in FIG. 8, in the vertical position and are to resist loads, both compressive and tensile. As far as an Integral Form is concerned, the primary function of the modified studs (1) is to hold the two composite sides in place until the concrete (4) has cured. Modified as shown, the tabs (20) in the modified studs (1) are to hold the rigid insulation (2) in place until the rib lathe (3) has been added and the plaster or stucco like material (19) has been applied. The plaster or stucco like material (19) is sprayed on under pressure and bonds with both the rib lathe (3) and the rigid insulation (2). The three, properly bonded together, function as a composite side. The steel reinforcement holes (15) in the center of the modified studs (1) are to allow the passage of steel reinforcement (6) and hold it near the center of the concrete (4) to be added later. The much larger oblong holes on the centerline of the modified studs (1) are to allow free passage of the concrete (4) in the horizontal direction. The wiring/plumbing holes (16) to the side are to allow passage of pipe, conduit and wiring of every type through the modified studs (1) and rigid insulation (2) which will be notched as required.

Figure 3:
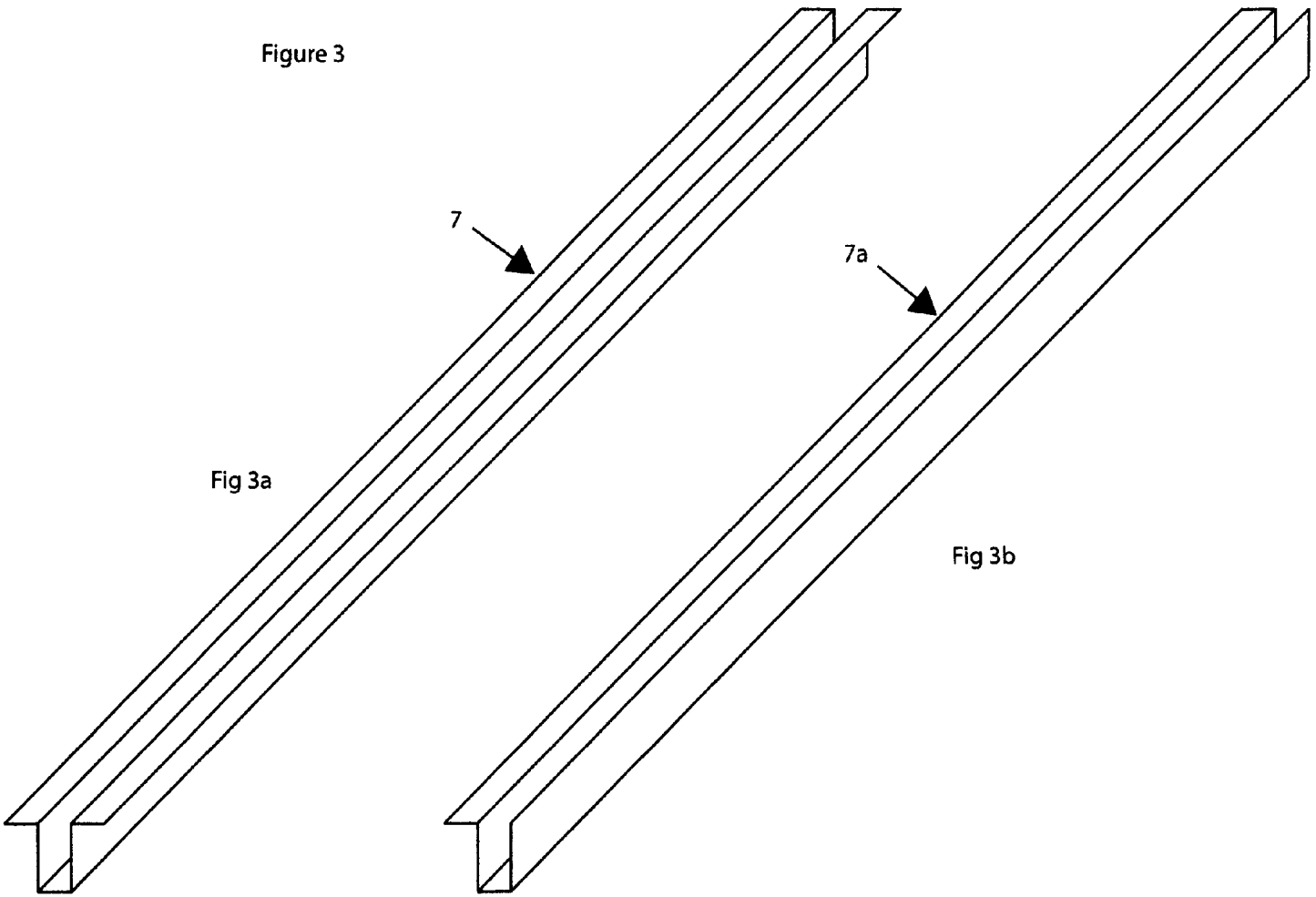
FIGS. 3*a* and 3*b* depicts a gull-wing metal joist to function as a floor joist or roof rafter and facilitate the manufacture of integral forms as described in the specification and a single wing metal joist respectively.

FIGS. 3*a* and 3*b* discloses the gull wing joist (7). The primary function of a joist is to span a distance between two supporting elements. This gull wing joist (7) is designed to create a void for steel (6) and concrete (4) that will be poured on site. The gull wings on the gull wing joist (7) are to hold the rigid insulation (2) in place. Note that the wing must be removed from one side of the end gull wing joist (7), effectively resulting in a single wing joist (7.*a*). Notice also that the gull wing joist (7) used in the upside down position functions as a roof rafter.

Figure 4:
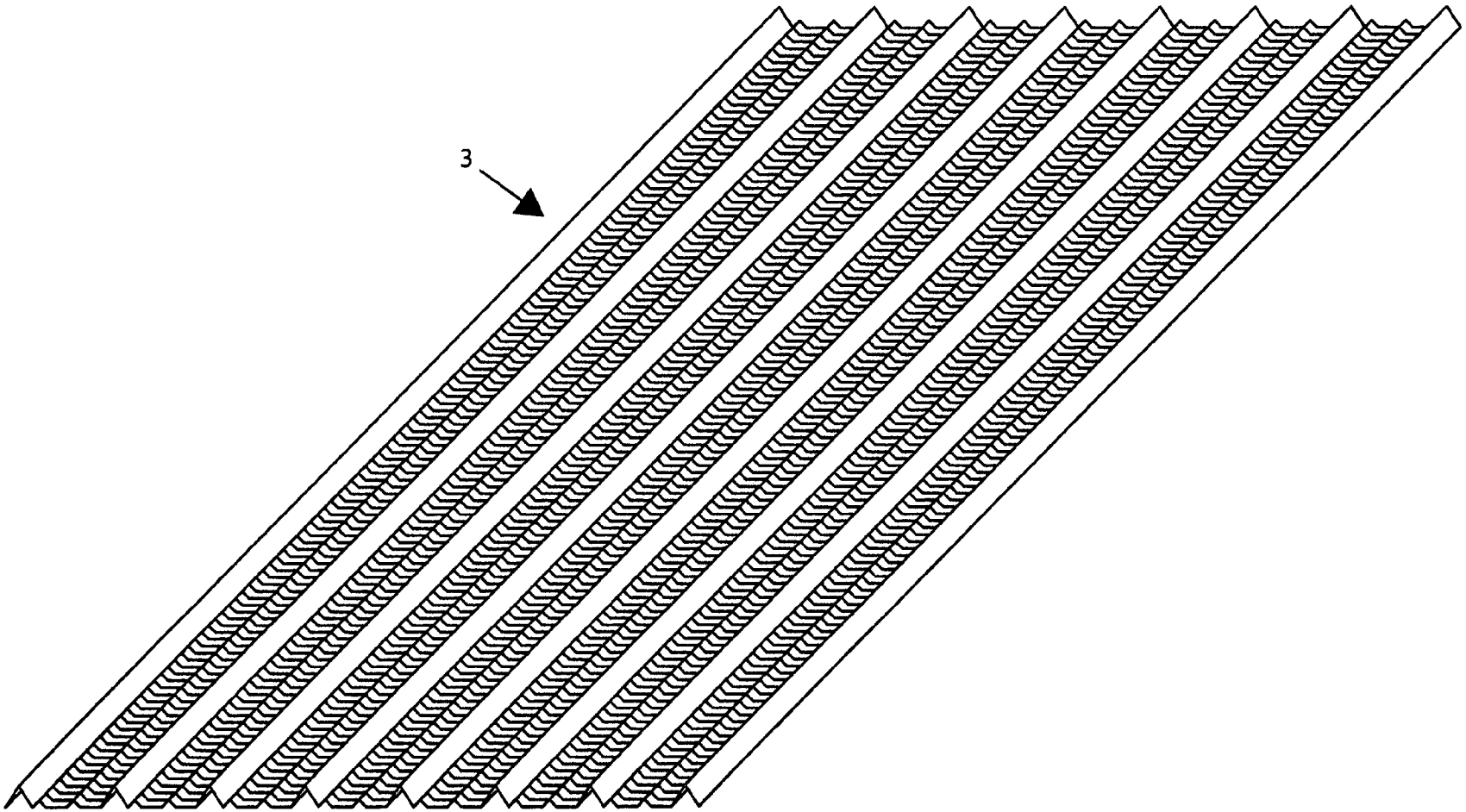
FIG. 4 depicts a rib lathe, a standard product currently in production and readily available.

FIG. 4 discloses the rib lathe (3). The rib lathe (3) is steel and effectively acts as reinforcement for the plaster or stucco like material (19). The ribs of the rib lathe (3) itself is solid, meaning not perforated, and is a more structural element serving to provide rigidity in the horizontal position which is perpendicular to the modified studs (1) and intended to hold the modified studs (1) in the proper position.

Figure 5:
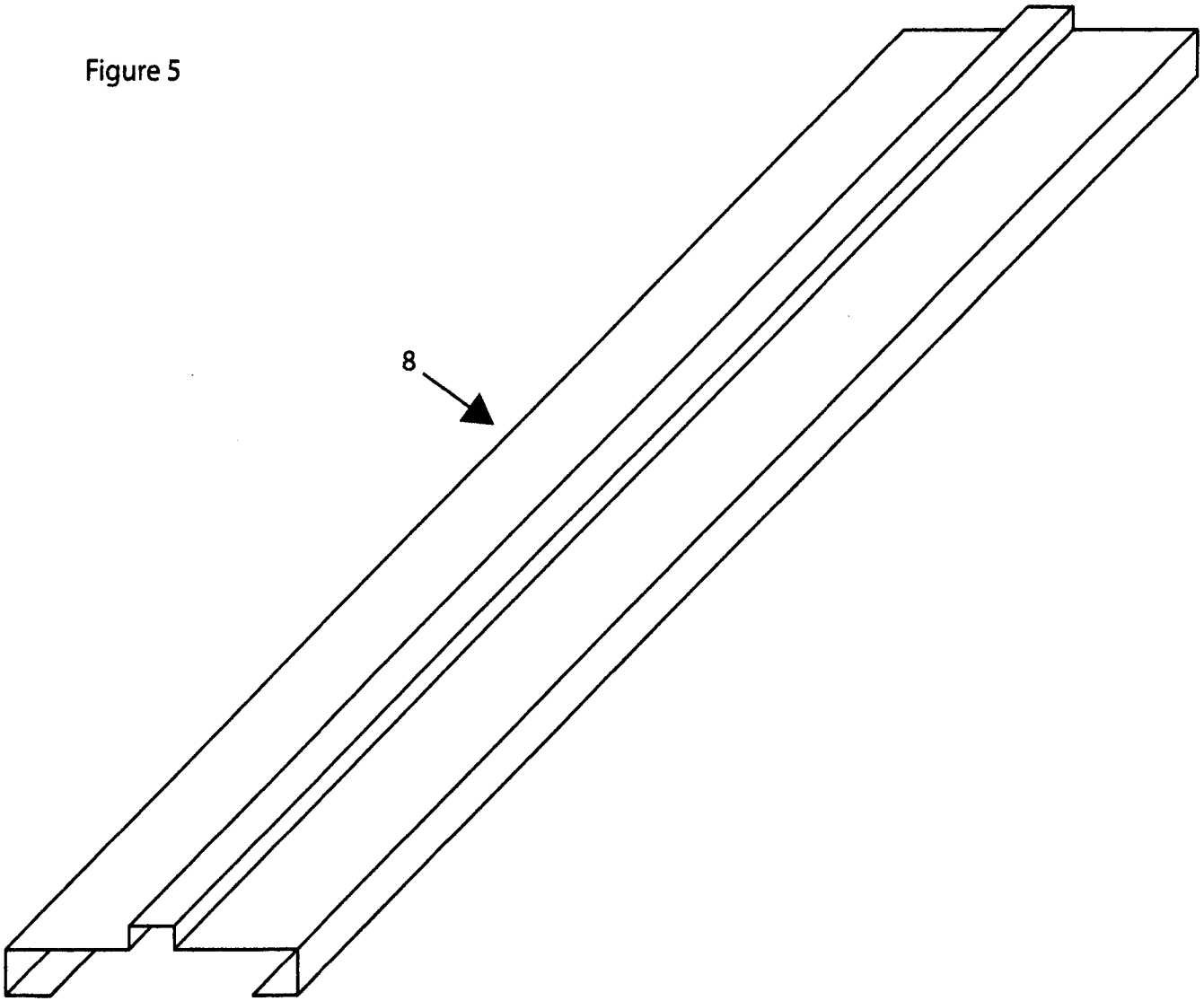
FIG. 5 depicts a hollow metal door and window jamb frame.

FIG. 5 is an isometric view of an opening jamb frame (8). This standard opening jamb frame (8) is used to frame door and window openings, and facilitate the mounting of same. This opening jamb frame (8) must be installed during the framing stage to define the opening and provide a stop for applying the plaster or stucco like material (19). All window and door opening jamb frames (8) are installed while the wall section is still lying flat on a framing table (not shown).

Figure 6:
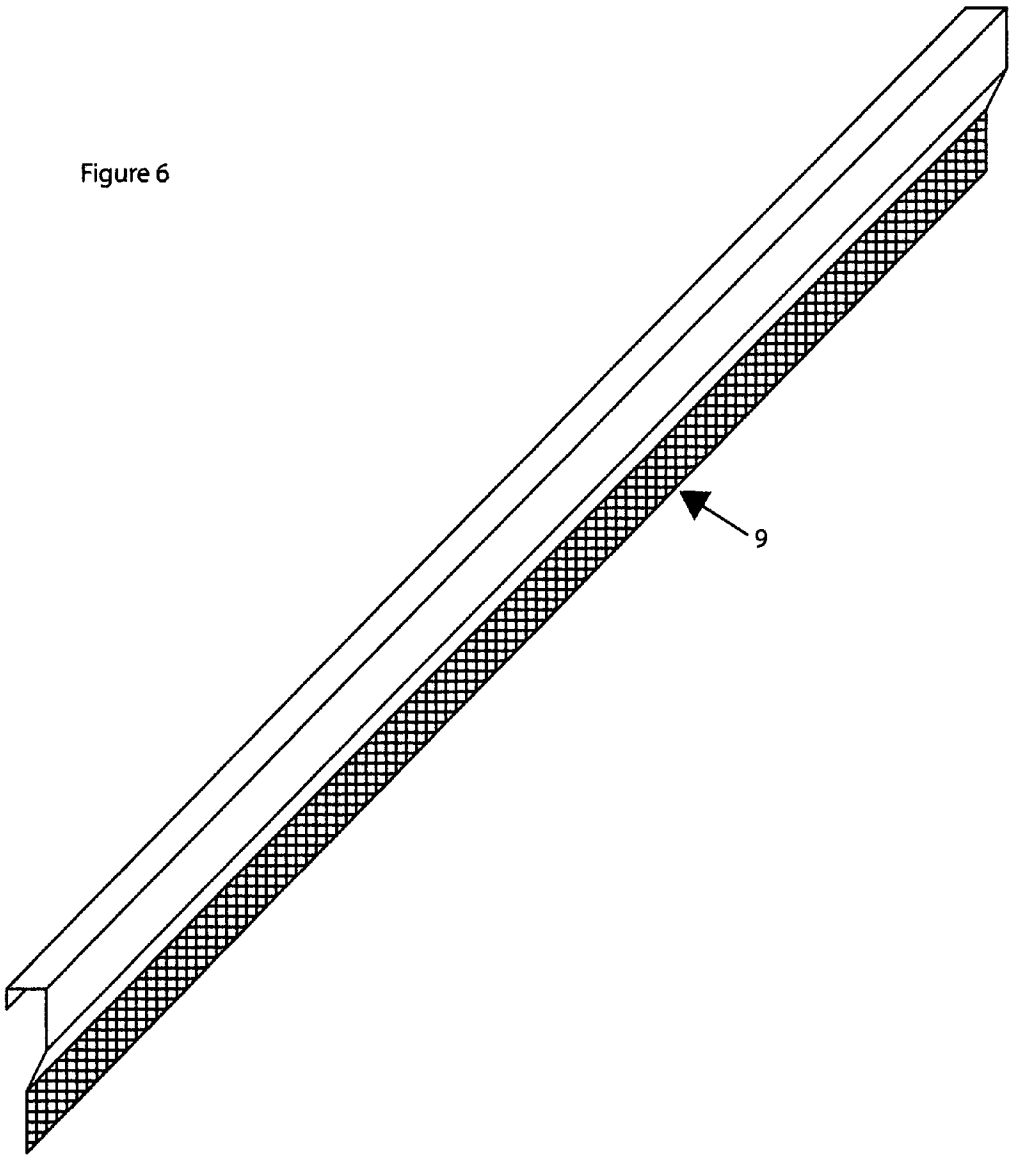
FIG. 6 shows a plaster or stucco like material stop.

FIG. 6 discloses a plaster or stucco like material stop (9) that is used to provide a connection device for the wall section assembly (11) to the floor/ceiling section assembly (12), and provide a reference for placement of the plaster or stucco like material (19).

Figure 7:
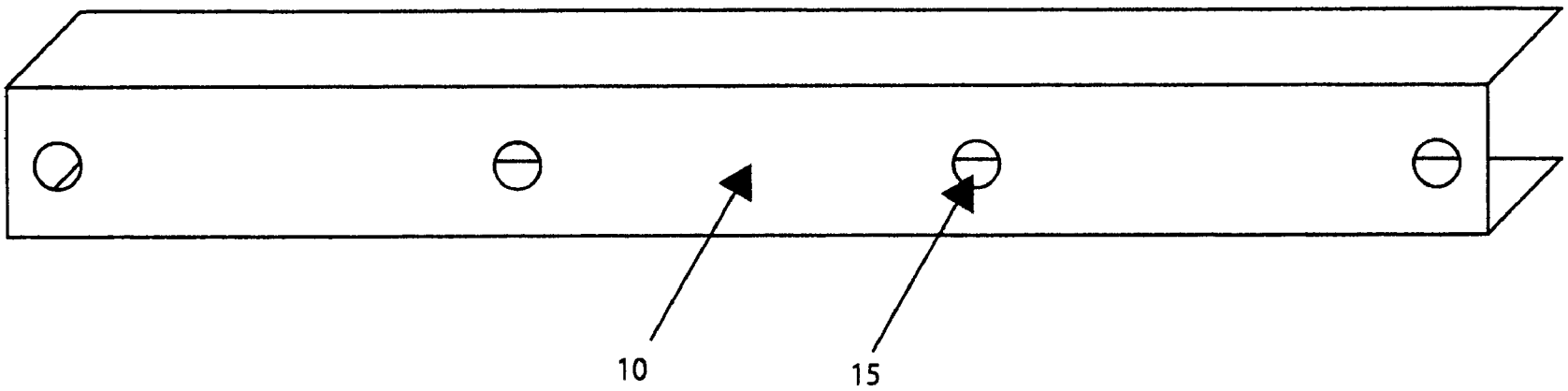
FIG. 7 depicts a "C" channel to hold the gull-wing joist in place.

FIG. 7 discloses a C channel (10) used to hold the floor/ceiling section assembly (12), which is more fully disclosed in figure (9), together while assembly and installation of the finished module (13) and/or while hauling and erection of the module (13) at the job site. The modules (13) are more fully disclosed in FIG. 14.

FIG. 8 shows how the parts will be assembled to make a wall section assembly (11). The first modified stud (1) is put in place on a framing table. The bottom rigid insulation (2) is then put in place, and the top rigid insulation (2) and the second modified stud (1) is added simultaneously. This sequence is repeated starting with the bottom rigid insulation (2). All piping, wiring, conduit and opening jamb frames (8) must be added at this time. Rib lathe (3) is added next and then the plaster or stucco like material stop (9). With everything in place the plaster or stucco like material (19) is then added to one side of the wall section assembly (11). The wall section assembly (11) is then turned over and the plaster or stucco like material (19) is added to the other side of the wall section assembly (11).

Figure 9:
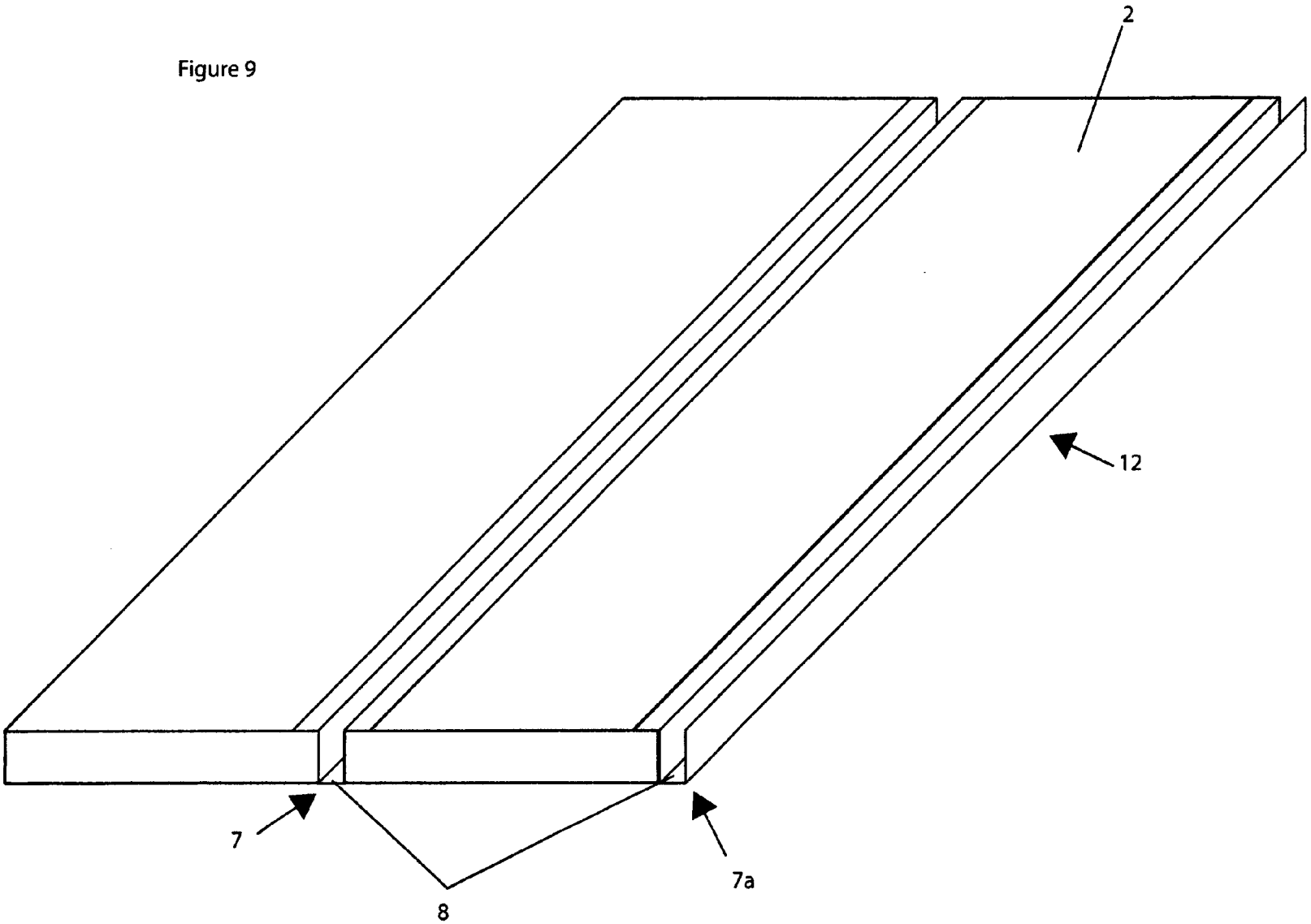
FIG. 9 shows a ceiling/floor section assembly.

FIG. 9 discloses the floor/ceiling section assembly (12) manufacture wherein the first gull wing joist (7) will be laid in place and then the first rigid insulation (2). This sequence will be repeated as required.

Figure 10:
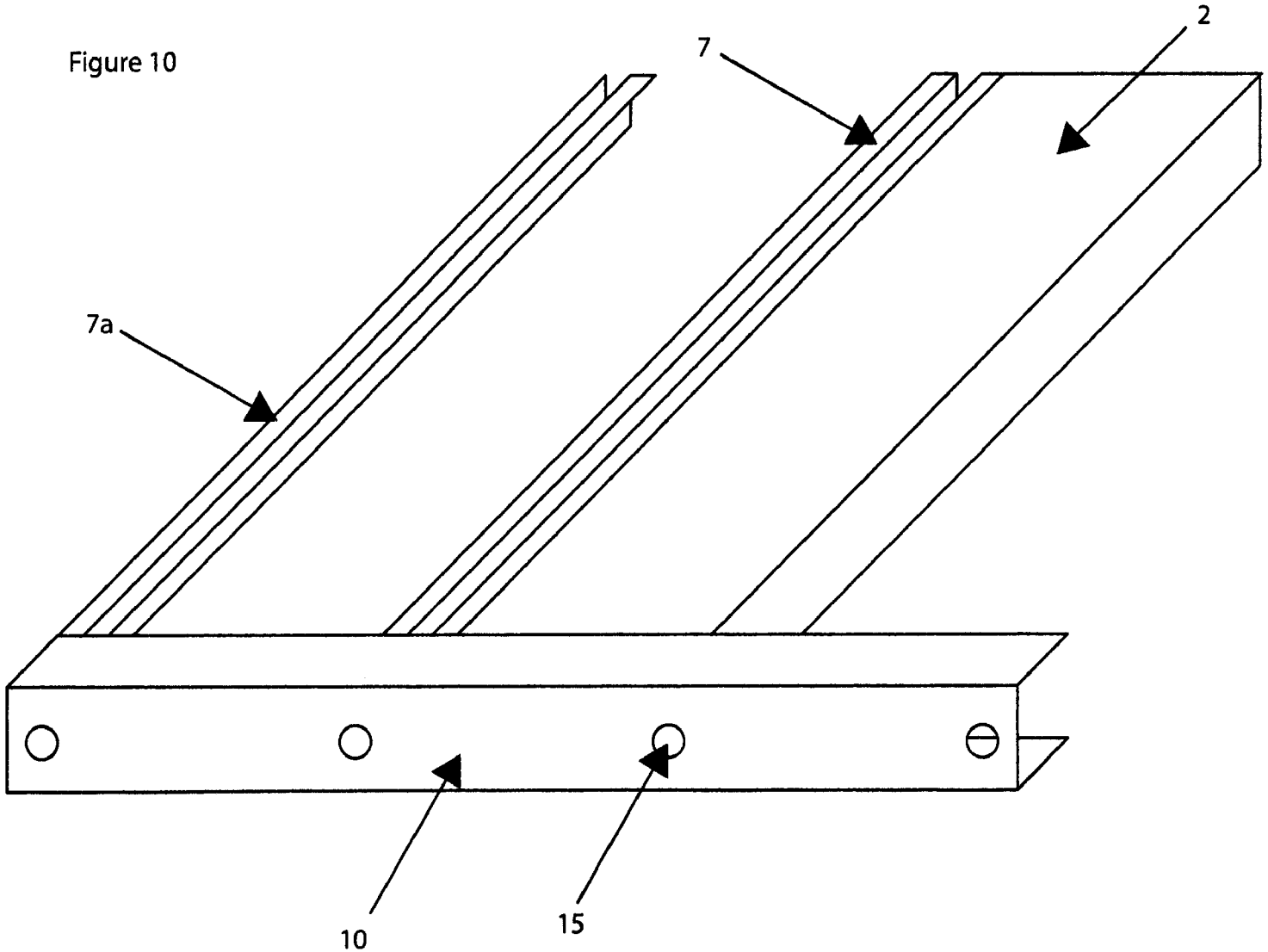
FIG. 10 depicts addition of "C" channel to ceiling/floor section assembly.

FIG. 10 discloses how the C channel (10) is added to hold the floor/ceiling section assembly (12) together during fabrication and erection.

Figure 11:
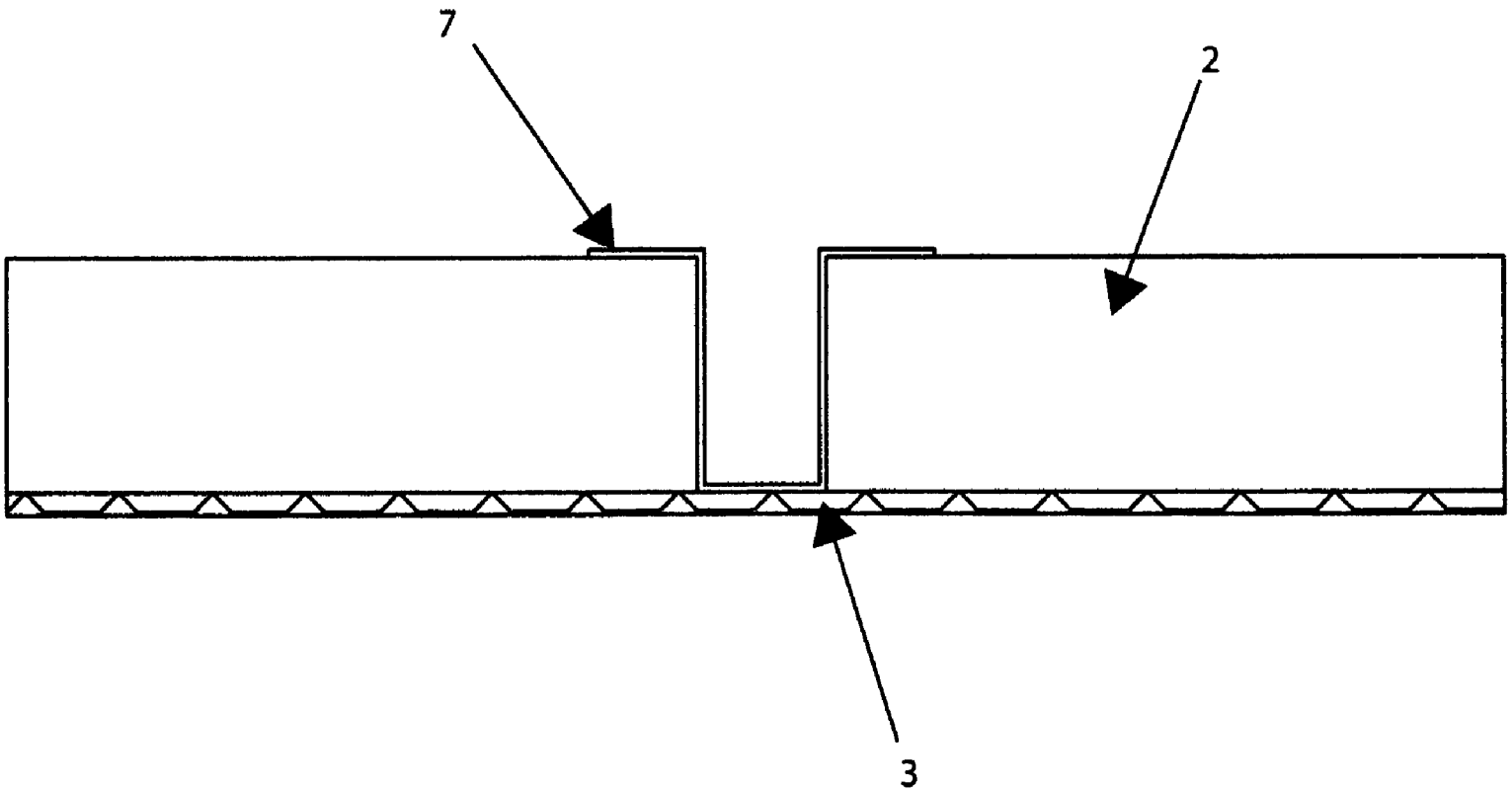
FIG. 11 shows a cross section of the assembly of a ceiling/floor section.

FIG. 11 further discloses part of the assembly of the floor/ceiling section assembly (12). With the floor/ceiling section assembly (12) in the upside-down position, the rib lathe (3) is added and then the plaster or stucco like material (19) is applied and finished.

Figure 12:
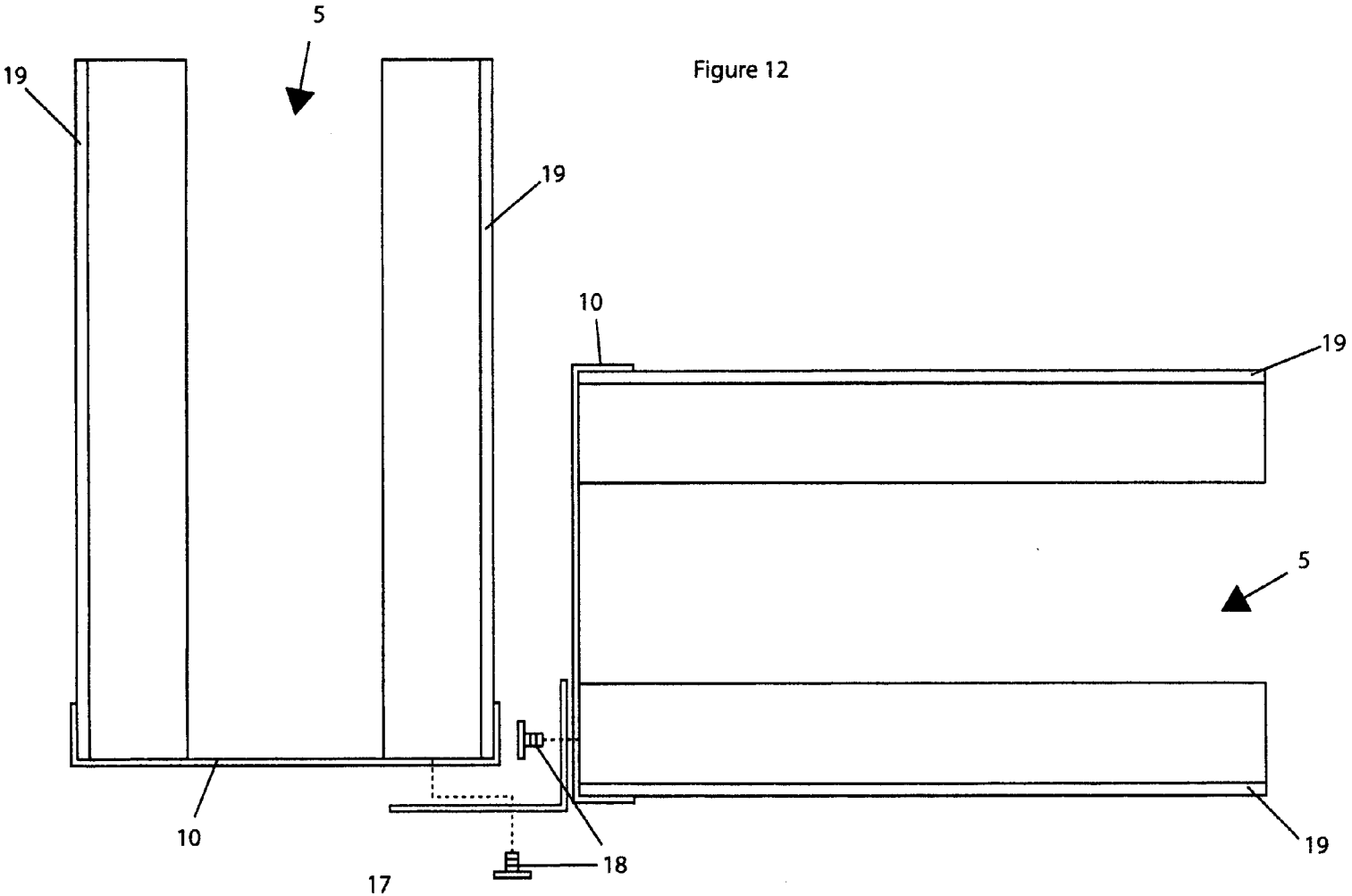
FIG. 12 depicts the attachment of walls to each other.

FIG. 12 discloses how angled attachment clips (17) are attached to the abutting wall section assembly (11), and then the two wall section assemblies (11) are to be placed in the proper position and the attachment clips (17) are attached to the abutment wall section assembly (11).

Figure 13:
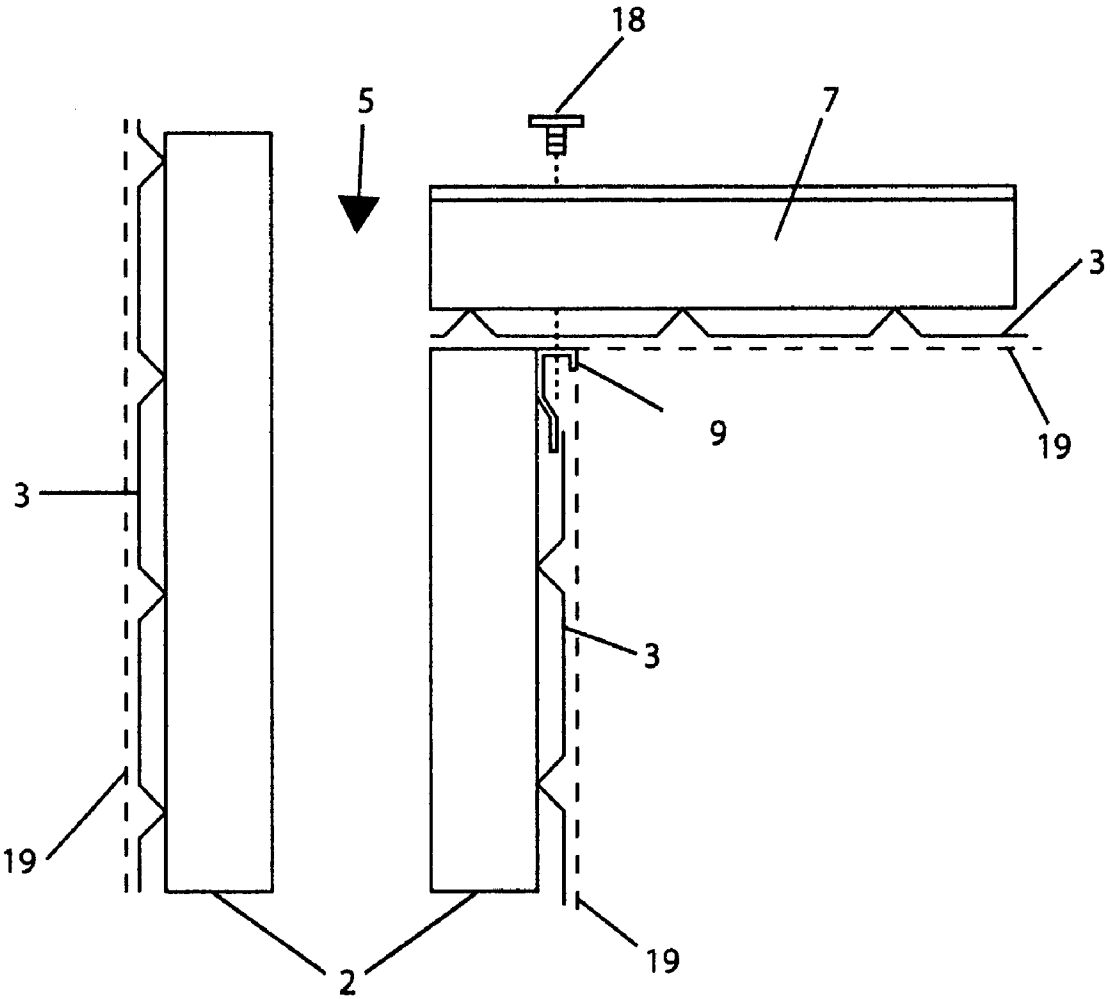
FIG. 13 depicts the ceiling/floor section attachment to exterior walls below.

FIG. 13 shows how the floor/ceiling section assembly (12) is attached to an exterior wall section assembly (11). This condition is the same for module (13) assembly in the plant or field erection of walls and floors on site. Notice that the outermost wall of the exterior wall section assembly (11) is higher than the innermost wall, this extension is to act as a rim beam as used in conventional construction. Also, the plaster or stucco like material (19) may not be applied all the way to the edges of the wall section assemblies (11) and floor/ceiling section assemblies (12) which allows for the addition of a corner piece of wire lathe (not shown) to be added as a part of the module assembly in the factory or while assembling in the field for additional structural integrity. The plaster or stucco like material (19) would then be added to the areas where it was left off after assembly.

Figure 14:
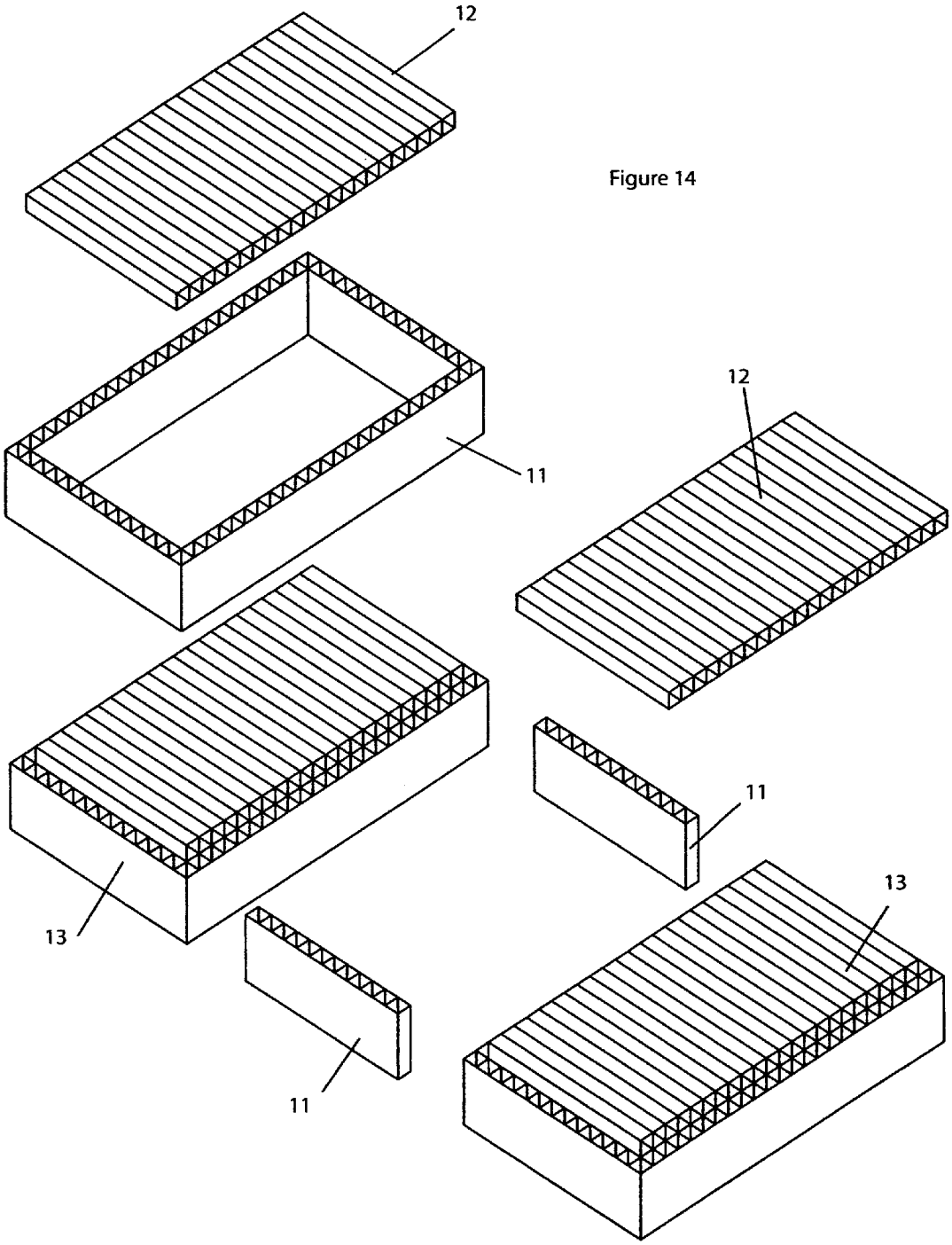
FIG. 14 shows a stack and arrangement of modules and sections on site.

FIG. 14 shows a possible sequence for stacking and arranging modules (13), wall section assemblies (11), and floor/ceiling section assemblies (12) on the job site. Note that the greatest stacking and arranging advantage is achieved when an odd number of modules (13) are used. The odd numbered modules (13) are full modules (13), while the additional sections (11 and 12) create enclosed spaces between the modules (13).

Figure 15:
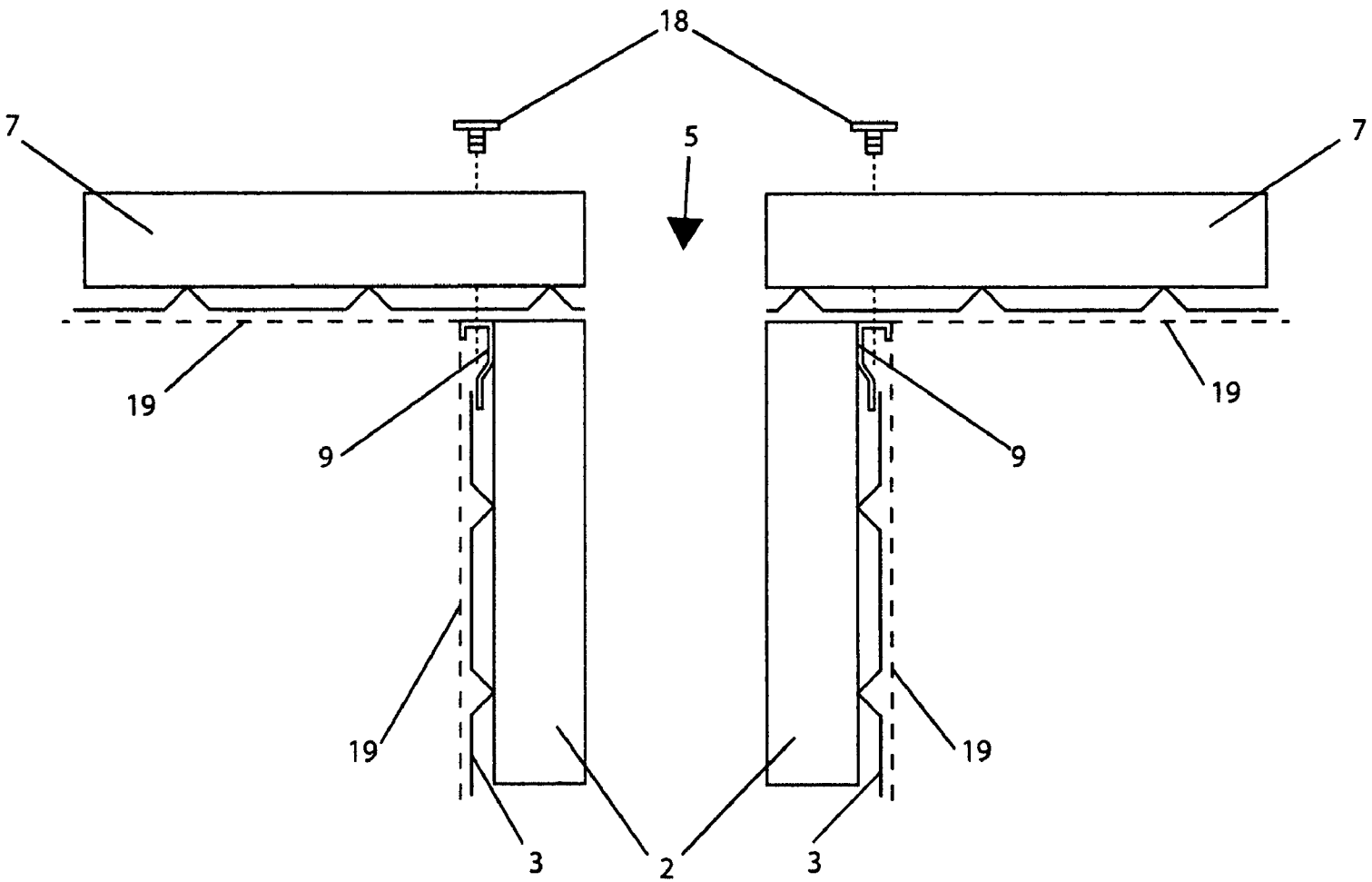
FIG. 15 depicts a party wall juncture.

FIG. 15 shows floor/ceiling connection to the party wall section assembly (11) section below. The party wall section assembly (11) and the right floor/ceiling section assembly (12) are delivered to the site as part of a module (13) while the left floor/ceiling section is installed at the site as a section.

Figure 16:
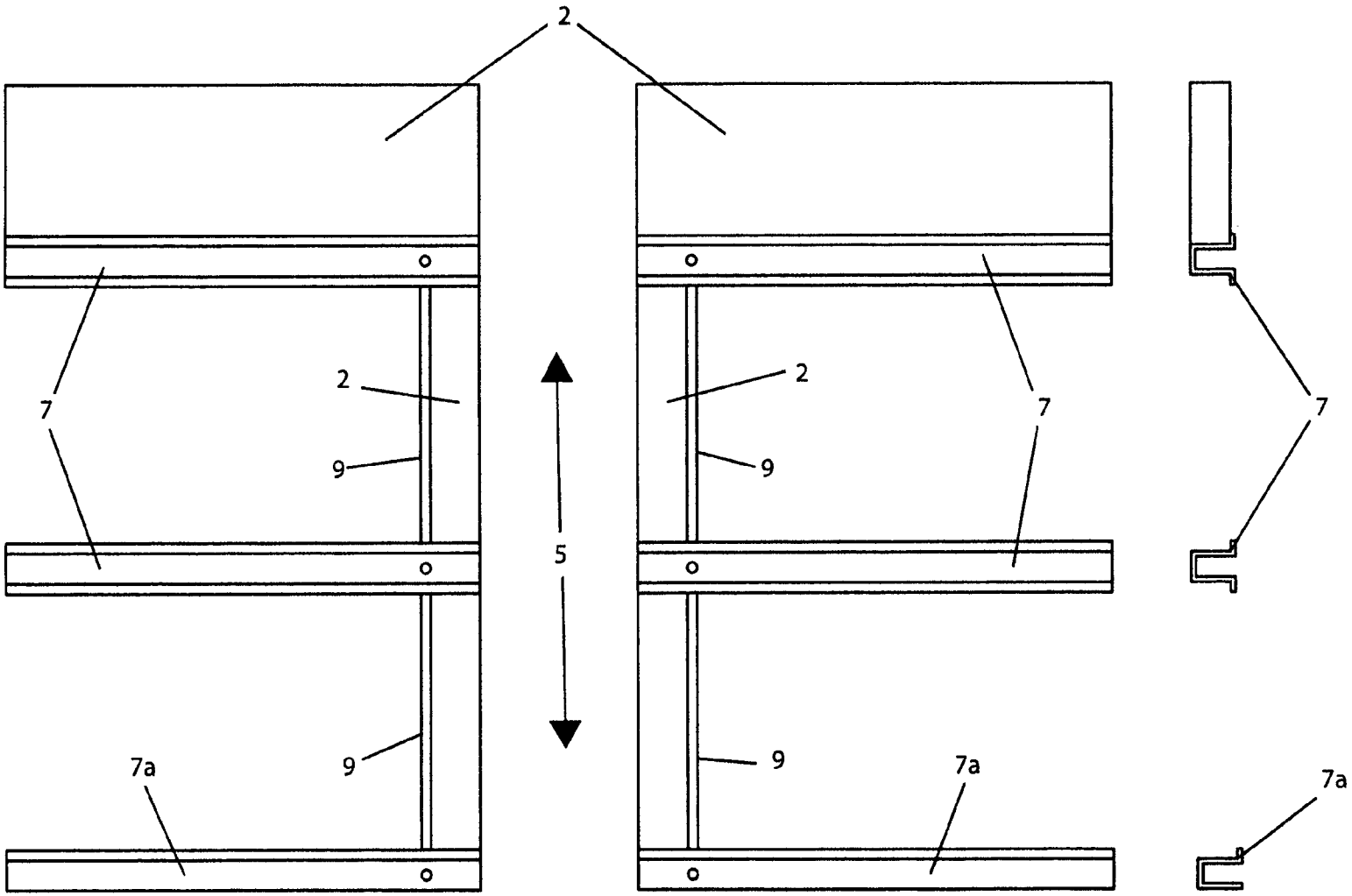
FIG. 16 shows a plan view of party wall.

FIG. 16 is a plan view of FIG. 15. Note the accessibility of the voids (5) within the wall section assembly (11) and interconnectivity with the voids (5) within the interior of the gull wing joist (7).

Figure 17:
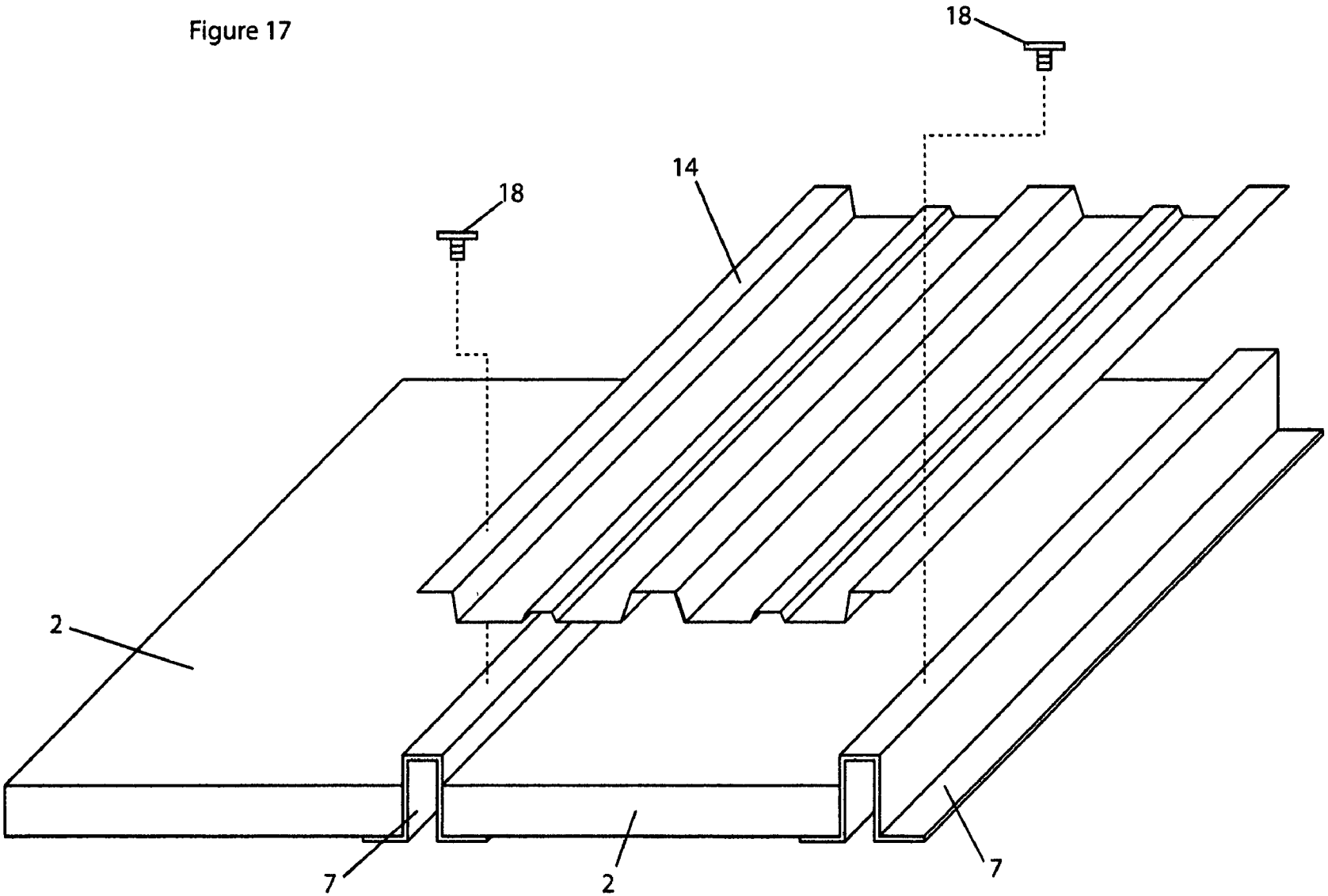
FIG. 17 shows a roof section assembly.

FIG. 17 shows how the gull wing joists (7) are to be installed on a framing table in the upside-down position such that they will function as roof rafters. The rigid insulation (2) is added next and then the pre-finished sheet steel roof membrane (14) as a water proofing membrane. The assembly is designed for a mechanical fastener (18) to penetrate the pre-finished sheet steel roof membrane (14) at the high point.

Figure 18:
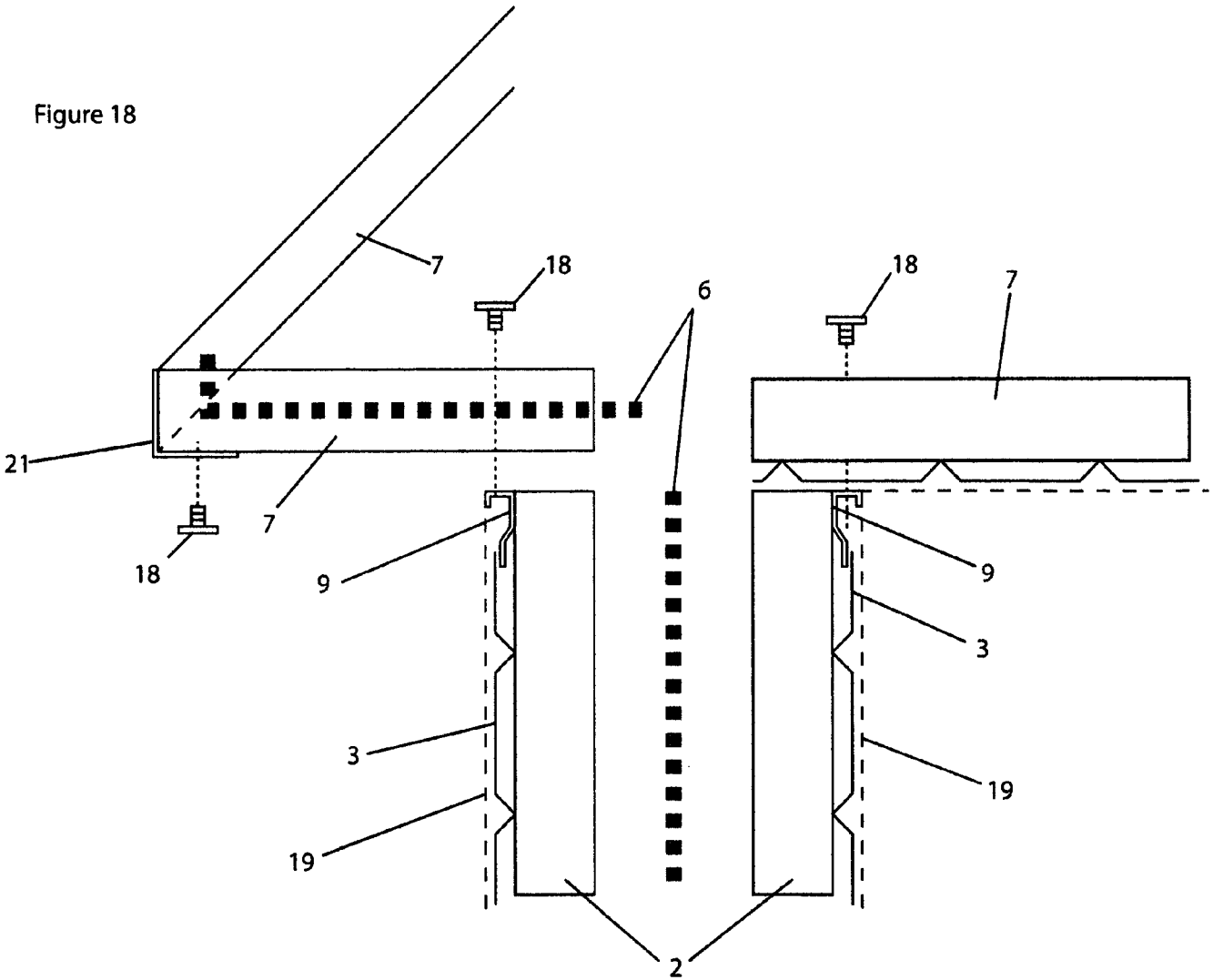
FIG. 18 depicts a roof section installation.

FIG. 18 shows the roof section, complete with the cornice (21), being installed atop a wall section assembly (11) on the site. With the roof section in its final position, the interconnecting steel reinforcement (6) will be added and zero slump concrete (4) will be shot into place within the interior voids (5) of the gull wing joist (7). Next the rib lathe (3) will be added and the plaster or stucco like material (19) will be installed on the ceiling and finished as appropriate.

What is claimed is:

1. A method of constructing a factory prefabricated and finished load bearing wall panel for use in a single family or single story or multi-level and multi-unit building, comprising the steps of:

a) first placing two parallel panels of rigid insulating material vertically between metal studs, leaving a central void between the panels of insulating material which are notched to accept piping, wiring, and associated devices;

b) next positioning two sheets of metal lathe horizontally on edge, to pass over and perpendicular to said metal studs and fastening said sheets of metal lathe to the flanges of said metal studs;

c) then inserting all piping, wiring, and associated devices that will go into the wall panel in the notched rigid insulating material and central void;

d) then applying a plaster or stucco like material or similar material to said metal lathe;

e) then factory finishing both sides of the wall panel;

f) the transporting to a construction site, assembling, and erecting the wall panel along with one or more similarly constructed wall panels to form the desired building structure;

g) then placing steel reinforcement in said central void at a construction site; and h) then finishing the single story or multi-level and multi-unit building by filling said central void of the wall panels with concrete at a construction site.

2. The method of claim 1 whereby said metal studs are placed longitudinally and held in place by fastening to a rib portion of said rib lathe running perpendicular to said metal studs.

3. The method of claim 1 whereby the web of said metal studs has punch-out slots, forming tabs to hold said rigid insulation in place.

4. The method of claim 1 further comprising the step of including opening material such as window or door jamb material within said wall panel to provide openings prior to applying a plaster or stucco like material or similar material to said metal lathe.

5. The method of claim 1 whereby said plaster or stucco like material is applied to said metal lathe and bonds to said rigid insulation thereby becoming a composite side wherein two composite sides are held in place by said metal studs forming an integral form.

6. The method of claim 1 whereby a number of said wall panels are assembled and erected to form a single family or single story or multi-unit and multi-story structure wherein such assembly of said wall panels create a central void accessible from the top of said wall panels.

7. The method of claim 6 whereby said central void in said multi-story structure is filled with steel reinforced concrete, thereby forming a monolithic wall unit.

8. The method of claim 1 further including the construction of factory prefabricated monolithic ceiling/floor sections for use in a multi-level and multi-unit building, comprising the additional steps of:

i) first installing sheets of rigid insulating material between a number of U-shaped with outwardly extending flanges gull-wing joists; which are placed in the upside down position for ease of assembly j) next fastening a sheet of metal lathe perpendicular to the bottom of said gull-wing joist;

k) then applying plaster or stucco like material or similar material to the bottom of said metal lathe;

l) then factory finishing said plaster or stucco like material or similar material;

m) then transporting to a construction site, assembling, and erecting said ceiling/floor sections on top of the erected wall panels such that said bottom of said metal lathe that was factory finished aligns downward and the U-shaped opening of said gull-wing joists align upward creating U-shaped voids extending the length of the ceiling/floor section; and, n) then finishing and strengthening said ceiling/floor section by filling the U-shaped voids of said ceiling/floor section with concrete at a construction site.

9. The method of claim 8 whereby said ceiling/floor sections form a monolithic structure functioning as both a floor and a ceiling in multistory structures.

10. The method of claim 9 whereby instead of transporting the wall panels and ceiling/floor sections to a construction site, said wall panels and ceiling/floor sections are assembled into modules and said modules are transported to a construction site.

11. The method of claim 10 whereby the module is a 5 sided cube having no floor.

12. The method of claim 11 wherein the modules are arranged on a job site with a space between to be enclosed as bay space between said modules.

13. A method of prefabricating roof sections consisting of the following steps:

a) Placing rigid insulation between a gull wing joist, which functions as a gull-wing rafter when in the upside down position b) Attaching a sheet steel waterproofing membrane to the top of gull-wing rafter, c) Attaching cornice work to what will be the lower end of the roof sections; and d) Attaching a ridge connection as necessary.

* * * * *